US005765824A

United States Patent [19]

Kawano et al.

[11] Patent Number: 5,765,824

[45] Date of Patent: Jun. 16, 1998

[54] SHEET FINISHER

[75] Inventors: Minoru Kawano; Masanobu Kawano, both of Hachioji; Hirohiko Okabe, Tokorozawa; Hirotaka Kataoka, Kawaguchi; Toshitaka Matsumoto, Asaka, all of Japan

[73] Assignee: Konica Corporation, Japan

[21] Appl. No.: 803,617

[22] Filed: Feb. 21, 1997

[30] Foreign Application Priority Data

Feb. 29, 1996 [JP] Japan ..... 8-042728

[51] Int. Cl.[6] ..... B65H 39/02

[52] U.S. Cl. ..... 270/58.11; 370/58.12; 370/58.13

[58] Field of Search ..... 270/58.01, 58.07, 270/58.08, 58.09, 58.11, 58.12, 58.13

[56] References Cited

U.S. PATENT DOCUMENTS

| | | | |
|---|---|---|---|
| 4,145,241 | 3/1979 | Snellman et al. | 270/58.16 X |
| 4,323,229 | 4/1982 | Meus | 270/58.18 |
| 4,444,491 | 4/1984 | Rinchart et al. | 270/58.14 X |
| 4,473,425 | 9/1984 | Baughman et al. | 270/58.08 X |
| 4,564,185 | 1/1986 | Hamlin et al. | 270/58.21 X |
| 5,044,618 | 9/1991 | Ettischer et al. | 270/58.08 |
| 5,106,069 | 4/1992 | Wolf et al. | 270/58.05 |

*Primary Examiner*—Hoang Nguyen
*Attorney, Agent, or Firm*—Jordan B. Bierman; Bierman, Muserlian and Lucas

[57] ABSTRACT

In a sheet finisher for use with an image forming apparatus, for receiving and aligning sheets discharged from the image forming apparatus, for then stapling the sheets together and for ejecting the stapled sheets to an exit tray, the sheet finisher includes: an intermediate stacker for receiving, aligning and stapling sheets discharged from the image forming apparatus; a conveyor for superimposing a first sheet and a second sheet in a sheet conveyance path upstream of the intermediate stacker, and then for conveying the superimposed sheets to the intermediate stacker to form a succeeding set of sheets to be stapled which follows a preceding set of sheets to be stapled in the intermediate stacker; a driver for driving the conveyor; and a controller for controlling the driver with respect to an operation timing of the driver.

7 Claims, 13 Drawing Sheets

SHEET FINISHER

BACKGROUND OF THE INVENTION

The present invention relates to a sheet finisher which receives sheets formed by an image forming apparatus such as an electrophotographic copier, a printer, a printing machine, or similar apparatus, automatically staples the sheets by a stapler, and after that, delivers the sheets to a sheet discharging tray by a sheet discharging means.

A sheet finisher, generally called a finisher, is used as an apparatus in which a plurality of sheets, on which images have been formed, and which are delivered from an image forming apparatus, are aligned and stapled for each set of copied sheets by a stapler.

This finisher is connected to the main body of an image forming apparatus such as a copier, a printer, or similar apparatus, and is driven corresponding to sequence operations of a copying or printing process.

Accordingly, in an image forming apparatus which can process an image forming process at high speed, a finisher is required which can follow the processing speed and perform its functions.

Regarding such a finisher capable of high speed processing, several proposals have been disclosed in Japanese Patent Publication Open to Public Inspection Nos. 142359/1985, 158463/1985, 239169/1987, and further, 288002/1987, 267667/1988, 276691/1990, and Japanese Patent Publication No. 41991/1993.

Image recorded sheets delivered from the main body of the image forming apparatus, are successively stacked on an intermediate stacker, while being collated, for each set of copied sheets; after one set of copied sheets has been stacked, it is sheet-finished by stapling and similar processing; each set of stapled sheets is conveyed by a discharging belt provided at the bottom portion of the intermediate stacker; and is sandwiched by a pair of sheet discharging rollers, and delivered onto a discharging tray.

Further, in a structure of the sheet finisher disclosed in Japanese Patent Publication Open to Public inspection No. 276691/1990, two fur brushes are rotatably provided in the sheet finisher, and tips of the fur brushes are in contact with a guide plate. In another sheet finisher disclosed in a sheet housing apparatus in Japanese Patent Publication Open to Public Inspection No. 214565/1989, a paddle wheel, on which a plurality of blade members are radially provided, is rotated for adjusting the sheets. In still another sheet finisher disclosed in Japanese Patent Publication Open to Public Inspection No. 116168/1988, a portion of a belt, the lower end portion of which is in contact with the intermediate tray, is wound around the lower roller of a pair of discharging rollers, the belt is rotated together with the lower roller, and delivered sheets on the intermediate tray come into contact with a stopper.

Yet another sheet finisher, disclosed in Japanese Patent Publication Open to Public Inspection No. 127556/1989, is provided with the first and the second sheet conveyance paths which convey sheets sent from the image forming means to the sheet finishing means; a conveyance direction switching means which switches the first and the second sheet conveyance paths; and a control means which controls the conveyance direction switching means so that the sheets can be sent to the second sheet conveyance path corresponding to the operation of the sheet finishing means.

In conventional sheet finishers, when a small number of small sized sheets (B5, A4, 8.5"×11" sheets, or the like) are stapled by a stapler and delivered by the sheet discharging means, the weight of a set of sheets is less than in cases in which a large number of larger sized sheets (A3, B4, 11"×17" sheets , 8.5"×11", or the like) are stapled by the stapler and delivered by the sheet discharging means, and therefore, when sets of sheets are delivered by the sheet discharging means at the same sheet discharging speed, sets of small sized sheets are heavily promoted to dash, and thereby, sets of sheets scatter, and are not uniformly aligned on the sheet discharging tray. Further, when the sheet discharging speed by the sheet discharging means is reduced, a subsequent sheet sent from the image forming apparatus to the sheet finisher at a predetermined speed, runs against near the trailing edge of the preceding set of sheets during discharge after stapling, and unacceptable sheet discharging occurs. When conveyance speed of the subsequent sheets into the intermediate stacker is delayed to avoid collision with the set of preceding sheets, the copy productivity is lowered.

SUMMARY OF THE INVENTION

As a result of solution and improvement of the above problems, an object of the invention is to provide a sheet finisher from which the following excellent effects are obtained: (1) the overall size of the sheet finisher is reduced; (2) sheet conveyance is effectively carried out without stopping the sheet finisher at a relayed portion from the preceding sheet set finishing to the subsequent sheet set conveyance; and (3) the final sheet of the preceding sheet set is securely aligned on the intermediate stacker.

The above object is attained by a sheet finisher in which sets of sheets are delivered on a sheet discharging tray after sheets, conveyed from an image forming apparatus, have been stacked on an intermediate stacker, aligned, and stapled by a stapler, wherein the sheet finisher comprises: a conveyance means by which the first sheet and the second sheet, sent from the image forming apparatus, are superimposed on a sheet conveyance path before being guided into an intermediate stacker, and are then conveyed into the intermediate stacker, so as to form a set of sheets next to the set of stapled sheets; a driving means for driving the conveyance means; and a control means for timing-controlling the driving means.

Further, the above object is attained by a sheet finisher in which sets of sheets are delivered on a sheet discharging tray after sheets, conveyed from an image forming apparatus, have been stacked on an intermediate stacker, aligned, and stapled by a stapler, wherein the sheet finisher comprises: a conveyance means for conveying the sheets to the intermediate stacker after the leading edge portions of the first sheet and the second sheet, sent from the image forming apparatus, are aligned by being collided with the conveyance means in a sheet conveyance path before being guided into the intermediate stacker, so as to form a set of sheets next to the set of stapled sheets; a driving means for driving the conveyance means; and a control means for timing-controlling the driving means.

BRIEF DESCRIPTION OF THE DRAWINGS

FIG. 2(*b*) is an illustration showing a sheet conveyance path in the second conveyance path.

FIG. 3(*b*) is an illustration showing a sheet conveyance path in the fourth conveyance path.

DETAILED DESCRIPTION OF THE PREFERRED EMBODIMENT

Next, an example of a sheet finisher of the present invention will be described, referring to the attached drawings.

Figure 1:
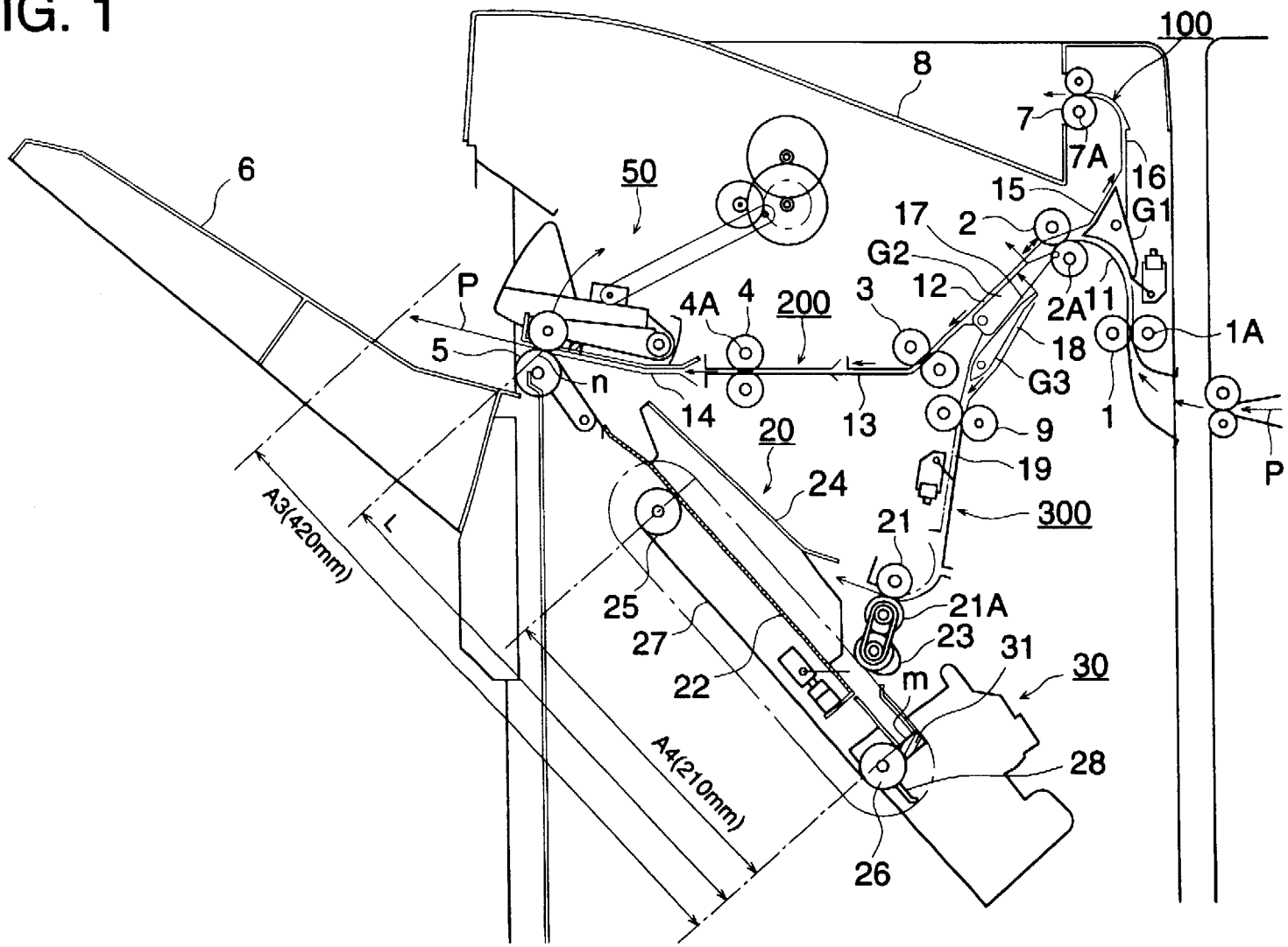
FIG. 1 is a sectional view showing a structure of a sheet finisher of the present invention.

FIG. 1 is a sectional view showing a structure of the sheet finisher (finisher). The sheet finisher is set by adjusting its position and height so that a receiving portion of a sheet P is aligned with a sheet discharging exit of the main body of the image forming apparatus (a copier, printer, or similar apparatus), and is connected to a control system so as to be driven corresponding to operations of the main body of the image forming apparatus.

A conveyance path of the sheet P, connected to the downstream portion of a sheet conveyance portion by paired rollers 1 at the entrance of the receiving portion, is branched into a first conveyance path 100 at an upper portion, a second conveyance path 200 at an intermediate portion, and a third conveyance path at a lower portion. The sheet P is sent into any of conveyance paths by selecting the angle of switching gates G1, G2 and G3.

Figure 2:
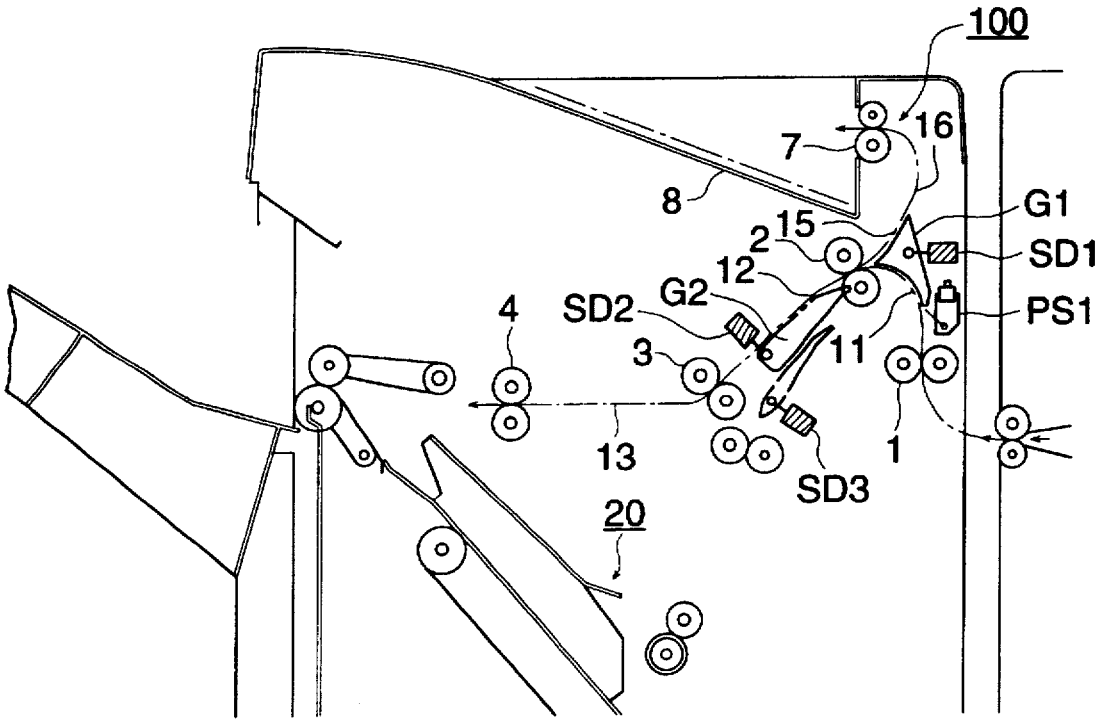
FIG. 2(*a*) is an illustration showing a sheet conveyance path in the first conveyance path.
Figure 2:
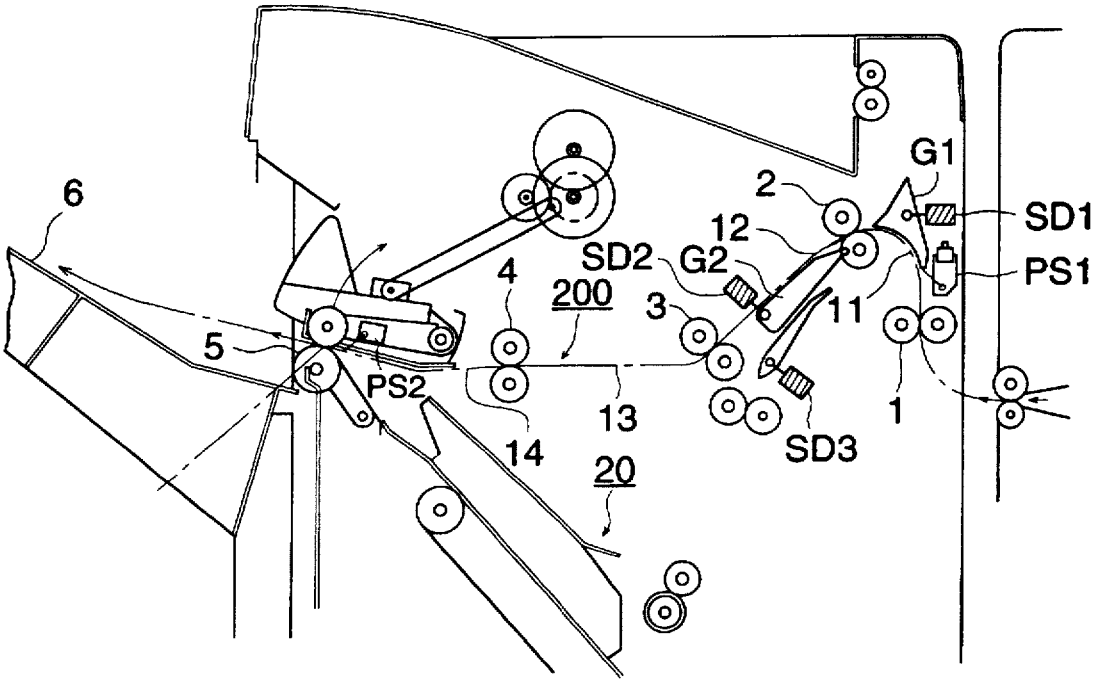
Figure 3:
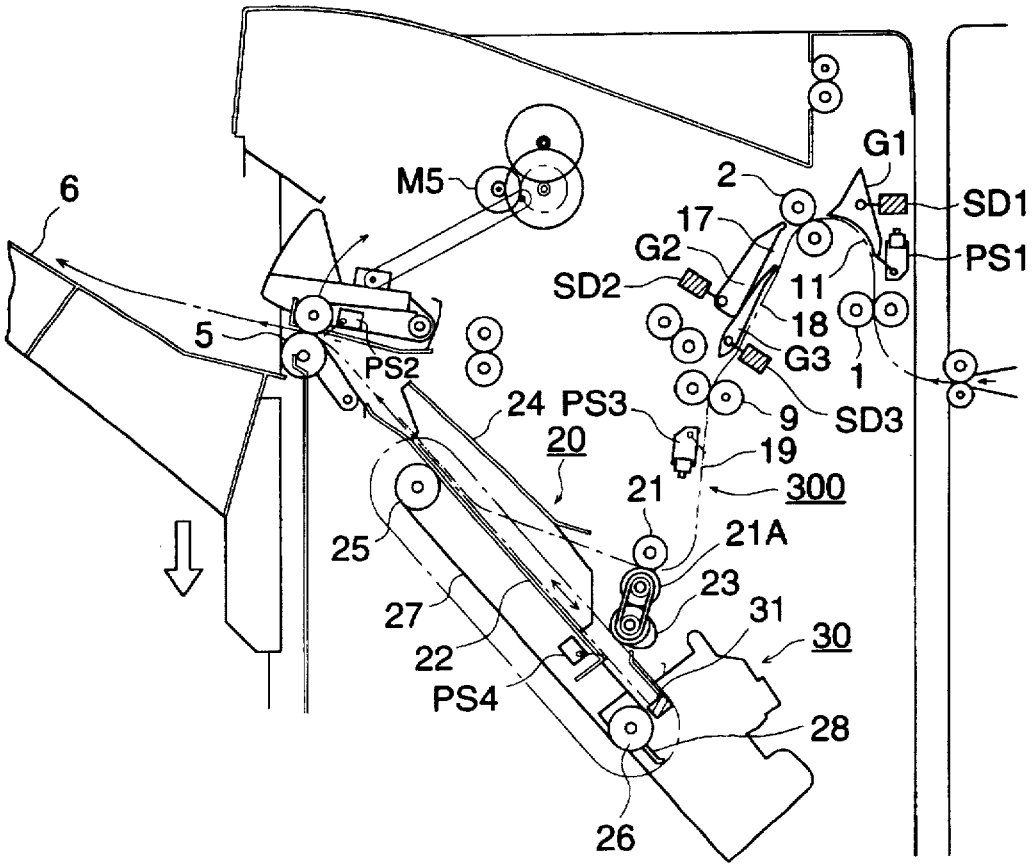
FIG. 3(*a*) is an illustration showing a sheet conveyance path in the third conveyance path.
Figure 3:
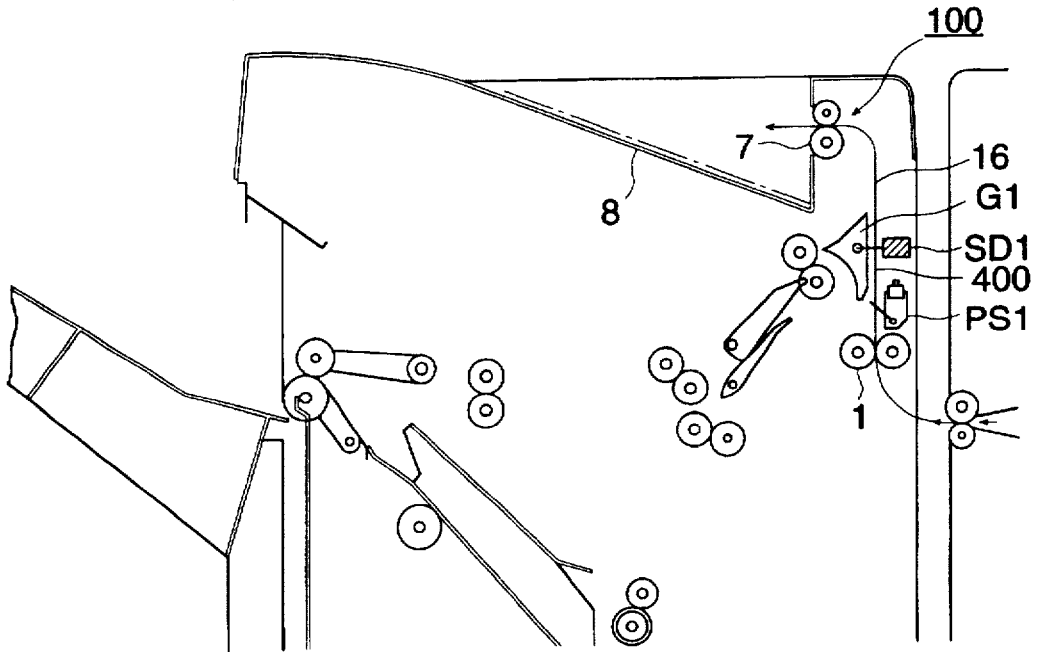

FIG. 2(*a*) is an illustration which shows a conveyance path for the sheet P in the first conveyance path 100 (by a one-dotted chain line). FIG. 2 (*b*) is an illustration which shows a conveyance path for the sheet P in the second conveyance path 200 (by a one-dotted chain line). FIG. 3(*a*) is an illustration which shows a conveyance path for the sheet P in the third conveyance path 300 (by a one-dotted chain line). FIG. 3(*b*) is an illustration which shows a conveyance path for the sheet P in the fourth conveyance path 400 (by a one-dotted chain line).

(1) The first conveyance path 100 (a printer mode, sheet discharging with its image surface facing downward)

In FIG. 2(*a*), the sheet P, delivered from the main body of the image forming apparatus with its image surface facing downward, is conveyed by paired rollers 1 at the entrance; the sheet P passes through a path 11, positioned below the first switching gate G1, positioned in the upper portion of the apparatus; and is nipped by paired conveyance rollers 2, passes through a path 12, which is in the second conveyance path 200, and positioned above the second switching gate G2 which is positioned diagonally below the paired conveyance rollers 2, passes through paired conveyance rollers 3, a path 13, and paired conveyance rollers 4, and is temporarily stopped there. After that, the sheet P is switched back by the paired conveyance rollers 2, 3 and 4, which are changed to be driven in reverse; passes through a path 15 above the first switching gate G1, and a path 16 above the path 15; and it is delivered on a sheet discharging tray 8 in the upper portion outside the apparatus, with its image surface facing downward (face-down) by paired discharging rollers 7, and is stacked on the tray 8 in the order of pages.

(2) The second conveyance path (a copier mode, sheet discharging with its image surface facing downward, a non-stapling mode including offset sheet discharging)

In FIG. 2(*b*), the sheet P, delivered from the main body of the image forming apparatus with its image surface facing upward, is conveyed by a roller pair 1 at the entrance; the sheet P passes through a path 11, positioned below the first switching gate Gl, which is positioned in the upper portion of the apparatus; it is nipped by paired conveyance rollers 2, passes through a path 12, which is in the second conveyance path 200, and is positioned above the second switching gate G2, which is positioned diagonally below paired conveyance rollers 2, passes through paired conveyance rollers 3, a path 13, and paired conveyance rollers (paired shift rollers) 4; and is delivered on a sheet discharging tray 6, provided outside the apparatus, with its image surface facing upward (face-down) by a pair of discharging rollers (a nipping and sheet discharging means) 5, and is stacked on the tray 6. In this connection, in an automatic document feeder (ADF) connected to the image forming apparatus, documents are exposure-processed from the last page, successively sent to the sheet finisher from a copy of the image forming processed last page, and are stacked on the sheet discharging tray 6 in the order of pages with the image surface facing downward.

(3) The third conveyance path 300 (a copier mode, sheet discharging with its surface facing upward, a stapling mode)

In FIG. 3(*a*), the sheet P which has been delivered with its image surface facing upward (face-up) in reverse order from the final page copy, image forming processed in the main body of the image forming apparatus, and successively sent into the sheet finisher, is conveyed by the paired rollers 1 at the entrance, and passes through a path 11 below the upper first switching gate G1; it is nipped by the paired conveyance rollers 2, and passes through a path (the first entry path) 18, which is the third conveyance path 300, and positioned below the third switching gate G3 located diagonally below the paired conveyance rollers 2, or a path (the second entry path) 17 above the switching gate G3; and is sent into a staple processing section 20 through paired conveyance rollers 9 and a path 19.

The sheet P which has been nipped and conveyed by paired conveyance rollers 21 located downstream of the path 19, is ejected in the space above an inclined intermediate stacker 22, comes into contact with the intermediate stacker 22 or the upper surface of the sheets P stacked on the intermediate stacker 22, and slides upward. After the trailing edge of the sheet has been delivered from a conveyance roller 21, it slides down on the inclined surface of the intermediate stacker 22 by its own weight, and comes into contact with the sheet stopper surface (a stopper member) located near a stapler (a stapling means) 30, and stops. An auxiliary rotating conveyance member (a drag-in member) 23, rotated by a belt wound around a pulley which is coaxially rotated with a lower roller 21B of the paired conveyance rollers 21, slides into contact with the upper surface of the downward-sliding sheet P, and thereby, when the sheet P is switched back, it securely comes into contact with the stopper member 31 by the sliding contact operation of the auxiliary rotating conveyance member (the drag-in member) 23.

Numeral 24 are a pair of alignment members provided to be movable on both side surfaces of the intermediate stacker 22. The alignment members 24 are movable in the direction perpendicular to the sheet conveyance direction. At the time of sheet receipt when the sheet P is ejected onto the stacker 22, the are opened wider than the sheet width, and when the sheet P slides down along the intermediate stacker 22 and stops by coming into contact with the stopper member 31, the alignment members 24 lightly knock the side edges of the sheets in the direction of the sheet width so that a set of sheets are laterally aligned (alignment). At this stop position, when a predetermined number of sheets P are stacked and aligned on the intermediate stacker 22, the sheets are staple-processed (staple processing) by the stapler 30 into a set of copied sheets.

A cutout portion is formed on a portion of the sheet stacking surface of the intermediate stacker 22, and a plurality of discharging belts 27, wound around a drive pulley 25 and a driven pulley 26, are driven to be rotatable. A discharging claw 28 is integrally formed on a portion of the discharging belt 27, and its tip portion forms a locus of ellipse as shown by a one-dotted chain line in the drawing. The rear end of the staple-processed set of sheets P is held by the discharging claw 28 of the discharging belt 27, and the set of sheets P is placed on the discharging belt 27, slides on the stacking surface of the intermediate stacker 22 and is pushed upward diagonally, and then moves to the nip position of the paired discharging rollers (the nipping and sheet discharging means) 5. The set of sheets P nipped by the rotating paired discharging rollers 5, is delivered and stacked on the sheet discharging tray 6 with its image surface facing upward.

(4) The fourth conveyance path 400 (the copier mode, sheet discharging with its image surface facing upward)

In FIG. 3(*b*), the sheet P delivered from the main body of the image forming apparatus with its image surface facing upward, is conveyed by the paired rollers 1 at the entrance, conveyed almost vertically upward, passes through a path (the fourth conveyance path) 400 located at the rear of the switching gate G1, further passes through the upper path 16, and is then delivered on the sheet discharging tray 8 in the upper portion outside the apparatus by the pair of discharging rollers 7, with its image surface facing upward (face-up).

Figure 4:
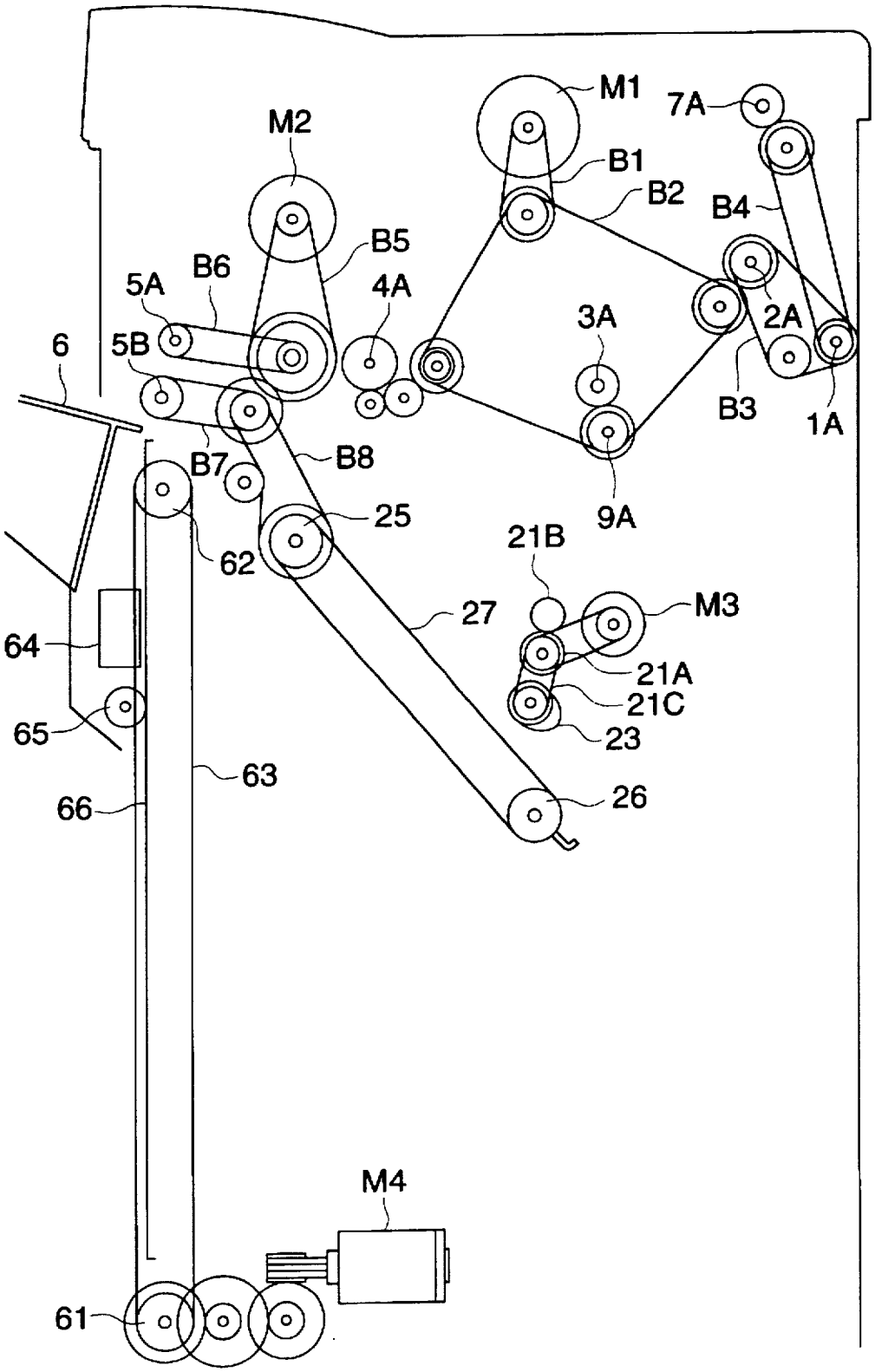
FIG. 4 is a structural view showing a driving system for the finisher.

FIG. 4 is a structural view showing a driving system of the sheet finisher. A motor M1 rotates a driving roller 9A (the left roller in FIG. 1) of the paired conveyance rollers 9 located in the third conveyance path 300 through timing belts B1 and B2, and also rotates, through a gear train, a driving roller 2A (the lower roller in FIG. 1) of the paired conveyance rollers 2, a driving roller 3A (the lower roller in FIG. 1) of the paired conveyance rollers 3, and a driving roller 4A (the upper roller in FIG. 1) of the paired conveyance rollers 4, which are located in the second conveyance path 200. Further, the motor M1 rotates a driving roller 1A (the right roller in FIG. 1) of the paired receiving roller 1 through a timing belt B3, and further, a driving roller 7A (the lower roller in FIG. 1) of the pair of discharging rollers 7 through a timing belt B4.

A motor M2 rotates a upper driving roller (hereinafter, referred to as the upper roller, in FIG. 1) 5A of the pair of discharging rollers 5 through timing belts B5 and B6, and also rotates a lower driving roller (hereinafter, referred to as the lower roller, in FIG. 1) 5B of the pair of discharging rollers 5 through a gear train and a timing belt B7. Further, a pulley driving the lower roller 5B rotates the driving pulley 25 through a timing belt B8, and also rotates a discharging belt 27.

A motor M4 rotates a driving pulley 61 through a gear train, and rotates a wire 63 wound around the driving pulley 61 and an upper driven pulley 62. The base portion of the sheet discharging tray 6 is fixed on a portion of the wire 63 by an engagement member 64. In the sheet discharging tray 6, a roller 65 rotatably supported by the base portion, slides along a rail member 66, and when the wire 63 is rotated, it can vertically move along the rail member 66.

Figure 5:
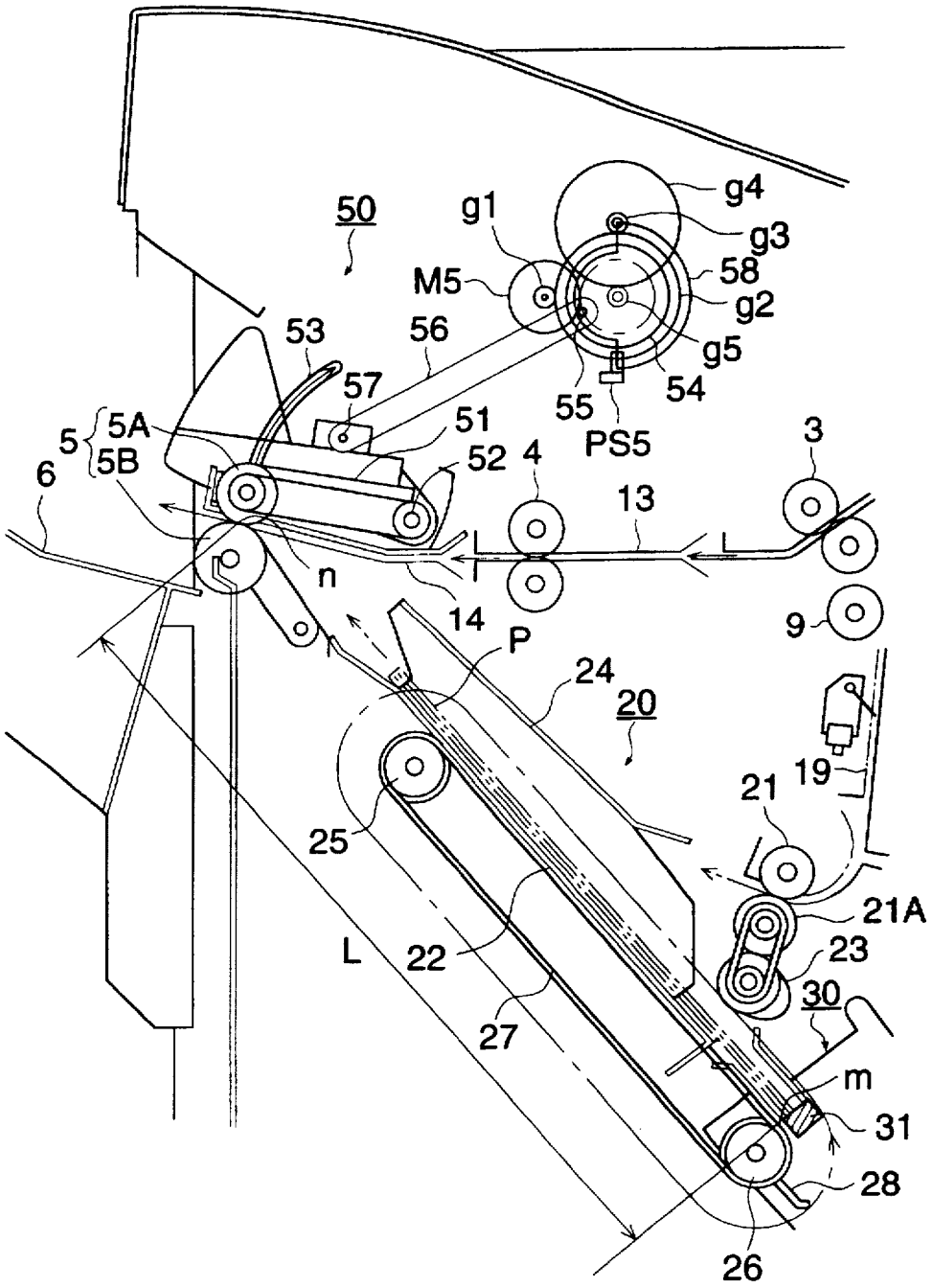
FIG. 5 is a sectional view showing a staple processing section and a sheet discharging section.
Figure 6:
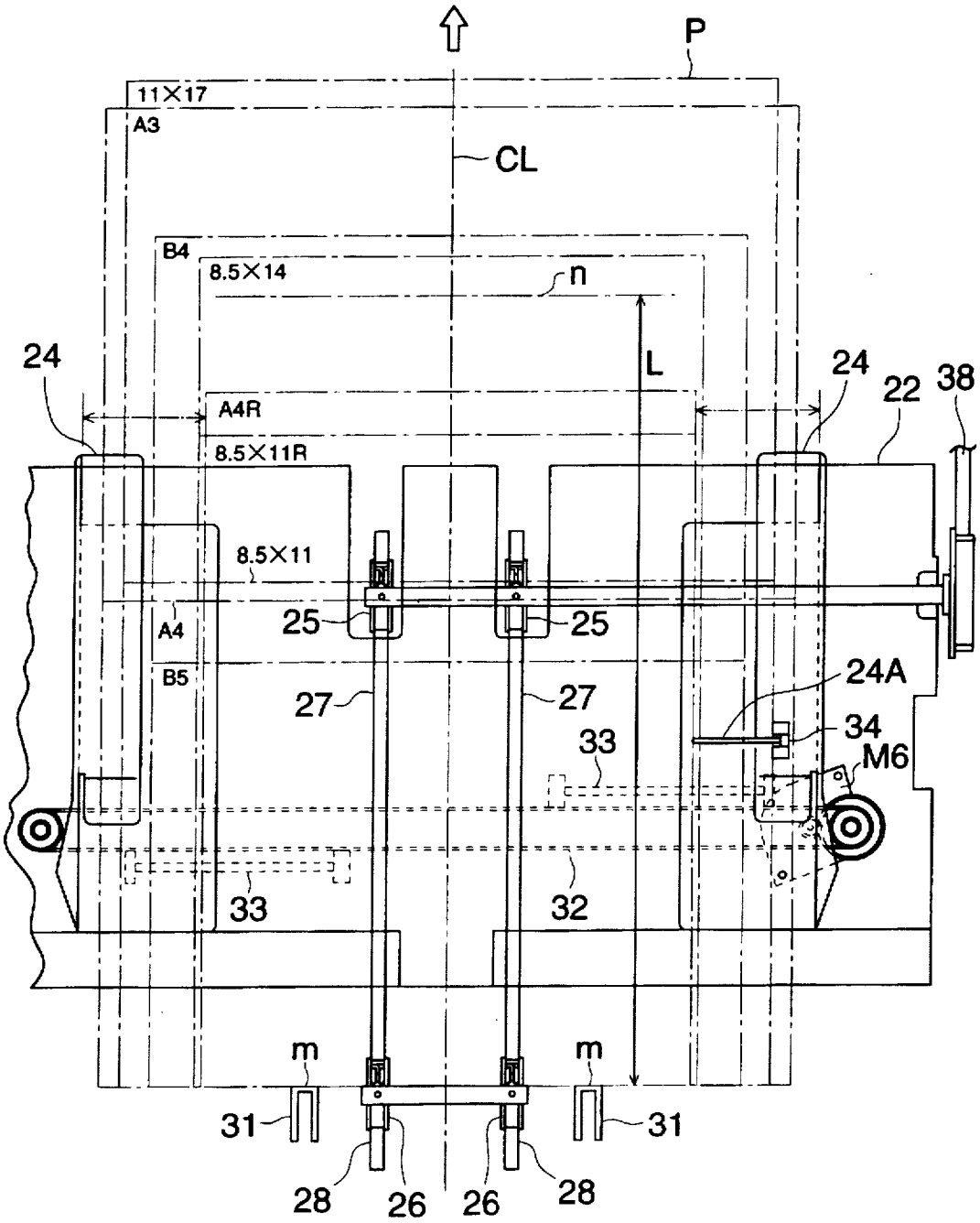
FIG. 6 is a plan view of the staple processing section.

FIG. 5 is a sectional view showing a staple processing section 20 and a sheet discharging section. FIG. 6 is a plan view of the staple processing section 20.

In FIG. 6, two alignment members 24 are symmetrically and horizontally arranged with respect to the center line CL, and are simultaneously movable in the direction perpendicular to the conveyance direction of the sheet P. The left and right alignment members are respectively fixed to a timing belt 32, and slide along a guide bar 33. The timing belt 32 is rotated by a stepping motor M6 through an intermediate gear train. FIG. 6 shows a situation in which the alignment members 24 are at the home position. This home position is detected and controlled by a protruded portion (a detected portion) 24A and a home position detection sensor 34, provided on the intermediate stacker 22. Incidentally, several sizes of sheets P are respectively shown by each of one-dotted chain lines in FIG. 6. In the present example, as an example, several sizes of sheets P, each having one of lengths of A3-size, B4-size, 11"×17", and 8.5"×14", are designated as large sized sheets, and the sheets P having shorter length are designated as small sized sheets. The distance L from the stopper surface (the sheet stopper surface) m, with which sheets come into contact, of the stopper member 31 located near the stapler 30 to the nip position n of the pair of discharging rollers 5, is set as a threshold position at which the larger sized sheets and the smaller sized sheets are distinguished. That is, the length of the smaller sized sheets P in the conveyance direction is less than the distance L, and therefore, they are placed at the upstream side of the paired discharging rollers 5. In contrast to this, because the length in the conveyance direction of the larger sized sheets P is longer than L, their leading edge portions come over the nip position of the paired rollers 5 to the downstream side, and they are placed also on the sheet discharging tray 6. The nip portion of the pair of sheet discharging rollers 5 is controlled to open and close, so that the larger sized sheets P are placed, aligned and stapled.

In FIG. 5, the paired sheet discharging rollers 5 is composed of the upper roller 5A and the lower roller 5B, which are respectively connected to and rotated by the motor M2, shown in FIG. 4. The lower roller 5B is rotated at a predetermined position. The rotatable upper roller 5A is supported by a holding member 51, and oscillates around a supporting shaft 52 along a circular arc long groove 53 provided in a side plate of the main body of the apparatus. That is, the rotating speed of a pinion gear g1 provided on a driving shaft of the motor M5, is reduced through a gear train composed of gears g2, g3, g4 and g5, so that a disk 54 is rotated. An eccentric pin 55 studded at an eccentric position on the disk 54 is connected to be rotatable to one end of a crank lever 56. The other end of the crank lever 56 is engaged to be rotatable with a pin 57, provided above the holding member 51. When the pinion gear g1 of the motor M5 is rotated and the disk 54 makes half a turn through the gear train, the crank lever 56 moves and oscillates the holding member 51, which supports the upper roller 5A, clockwise around the supporting shaft 52 along the long groove 53. When the rotating disk 54 makes half a turn, and the detected portion 58, provided on the disk 54, passes through the optical path of a photo-interrupter type sensor PS5, the drive of the motor M5 is stopped and the upper roller 5A is stopped while the sheet discharging path is opened.

Figure 7:
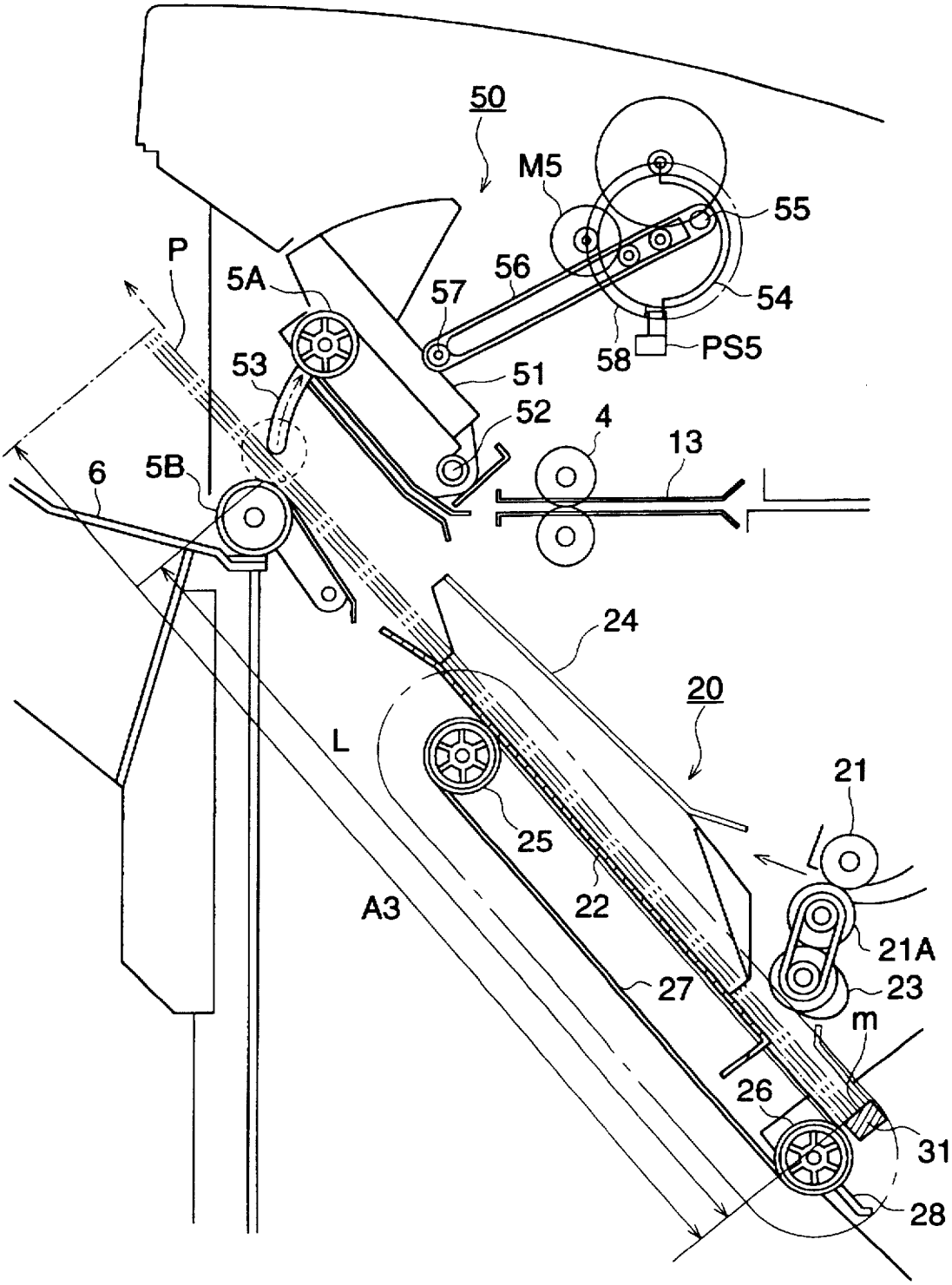
FIG. 7 is a sectional view showing a situation in which the upper roller of the paired discharging rollers is released and stopped.

FIG. 7 is a sectional view showing a situation in which the upper roller 5A of the opening/closing driving means 50 for the pair of discharging rollers is released and stopped. Under the situation in which the discharging path is opened, larger sized sheets are conveyed from the pair of entry portion rollers 21 of the intermediate stacker onto the intermediate stacker 22, are aligned and staple-processed.

Figure 8:
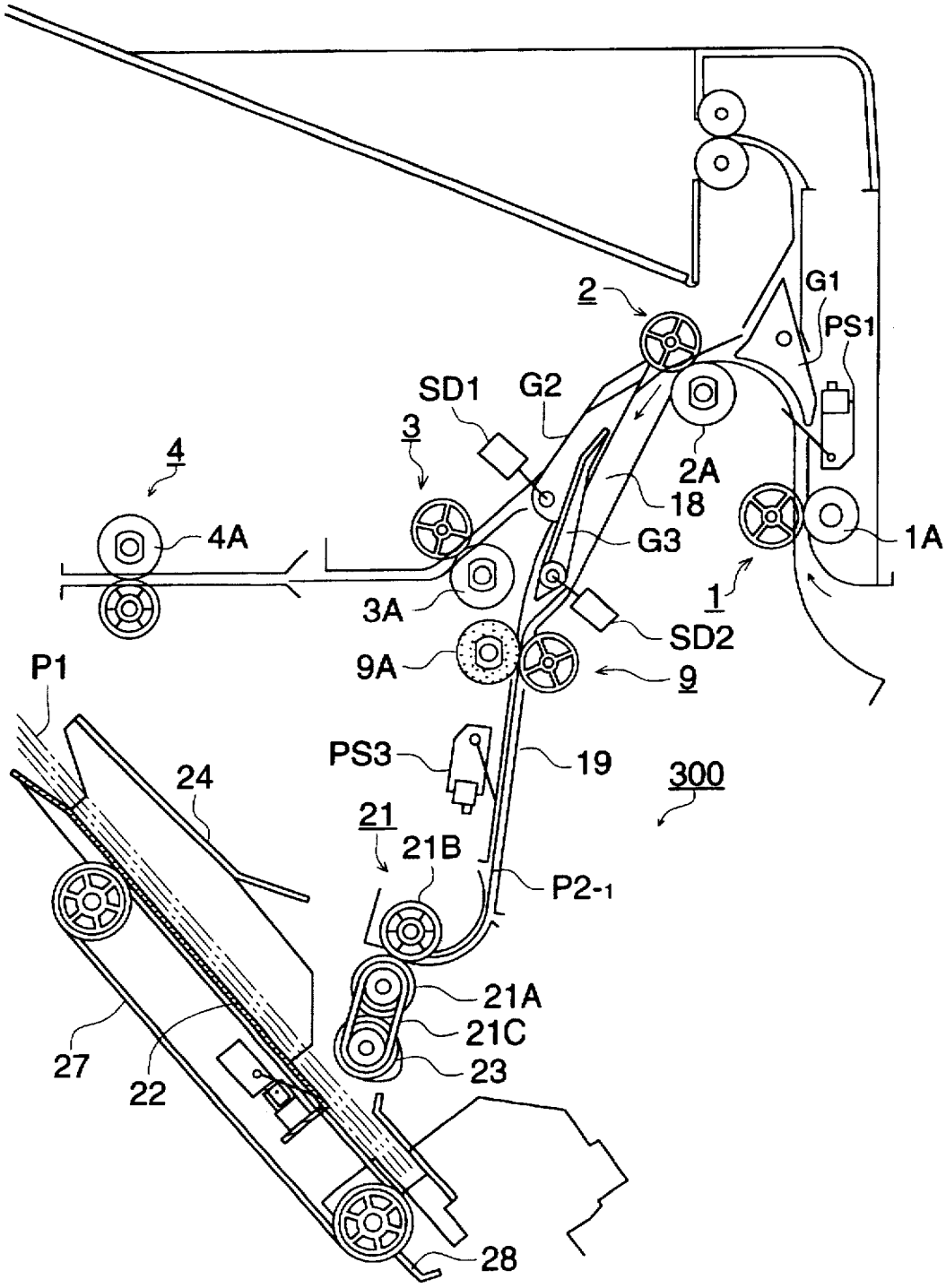
FIG. 8 is a sectional view showing a conveyance situation of the first sheet (the first conveyance mode) in the third conveyance path.

FIG. 8 is a sectional view showing the conveyance status of the first sheet in the third conveyance path 300 (refer to FIG. 3). In the first conveyance mode in the third conveyance path 300, the second switching gate G2 is activated by a solenoid SD1, and opens the entry portion of the third conveyance path 300. The third switching gate (a switching means) G3 is initially activated by a solenoid SD2, so that sheets can pass through the first entry path 18. In this situation, while a final sheet of the preceding set of sheets P1 is sent from the paired conveyance rollers 21, aligned on the intermediate stacker 22, the set of sheets P1 is staple-processed, and delivered from the intermediate stacker 22, the first sheet $P2_{-1}$ of a subsequent set of sheets P2 enters the first entry path 18 through pairs of conveyance rollers 1 and 2, passes the lower surface side of the third switching gate G3, comes into contact with the outer peripheral surface of a roller, located near the nipping position of the paired conveyance rollers 21 which has been stopped, through the paired conveyance rollers 9 and the path 19, then stops, and is ready for the next operation. In this connection, in these paired conveyance rollers, the driving rollers 1A, 2A, 3A and 4a are made of a dense rubber, and the driving roller 9A is made of a porous rubber.

Figure 9:
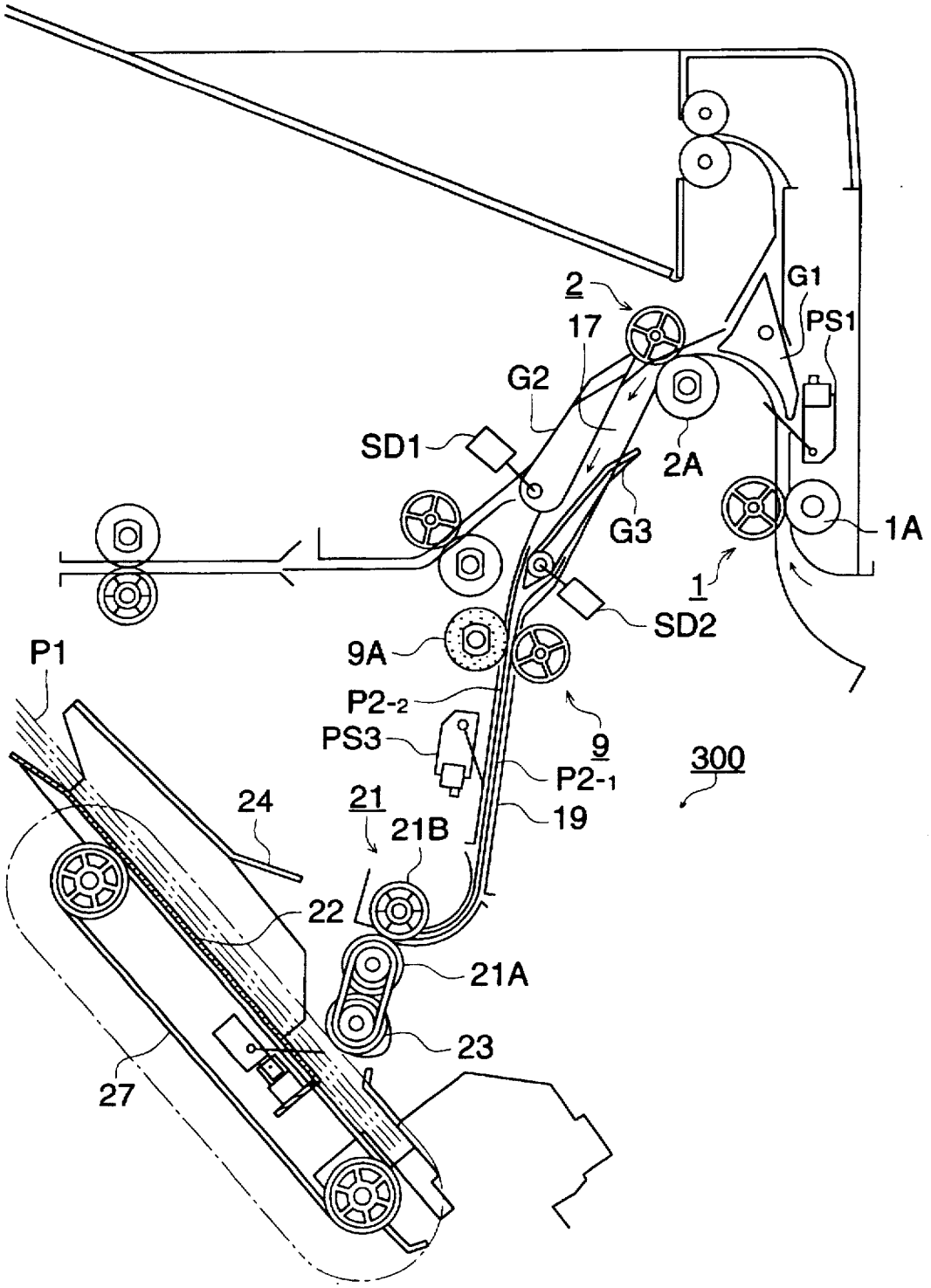
FIG. 9 is a sectional view showing a conveyance situation of the first and second sheets (the second conveyance mode) in the third conveyance path.

FIG. 9 is a sectional view showing the conveyance status of the first sheet and the second sheet in the third conveyance path 300. In the second conveyance mode, in the same manner as in the first conveyance mode, the second switching gate G2 is activated by the solenoid SD1, and opens the entry portion of the third conveyance path 300. The third switching gate G3 is switched by the solenoid SD2, so that the second entry path 17 can transport sheets. In this situation, the second sheet $P2_{-2}$ of the set of subsequent sheets P2 is branched from the first entrance path 18 through the paired conveyance rollers 1 and 2, enters the second entry path 17 located above the path 18, passes over the upper surface of the third switching gate G3, is conveyed in sliding contact with the surface of the leading edge portion of the first sheet $P2_{-1}$, which has been stopped, through the paired conveyance rollers 9 and the path 19, comes into contact with the outer peripheral surface of a roller located near the nipping position of the stopped pair of conveyance rollers 21, then is stopped, and is then ready for the next operation. In this "ready" situation, the first sheet $P2_{-1}$ and the second sheet $P2_{-2}$ are superimposed on each other in the path 19, the leading edge portions of them come into contact with the outer peripheral surface of the roller located near the nipping position of the stopped pair of conveyance rollers 8, and are aligned. In this manner, two sheets $P2_{-1}$ and $P2_{-2}$ pass through different sheet conveyance paths, and thereby, the leading edge of the subsequent sheet $P2_{-2}$ does not collide with the rear of preceding sheet $P2_{-1}$, and as a result, does not cause paper jamming.

Figure 10:
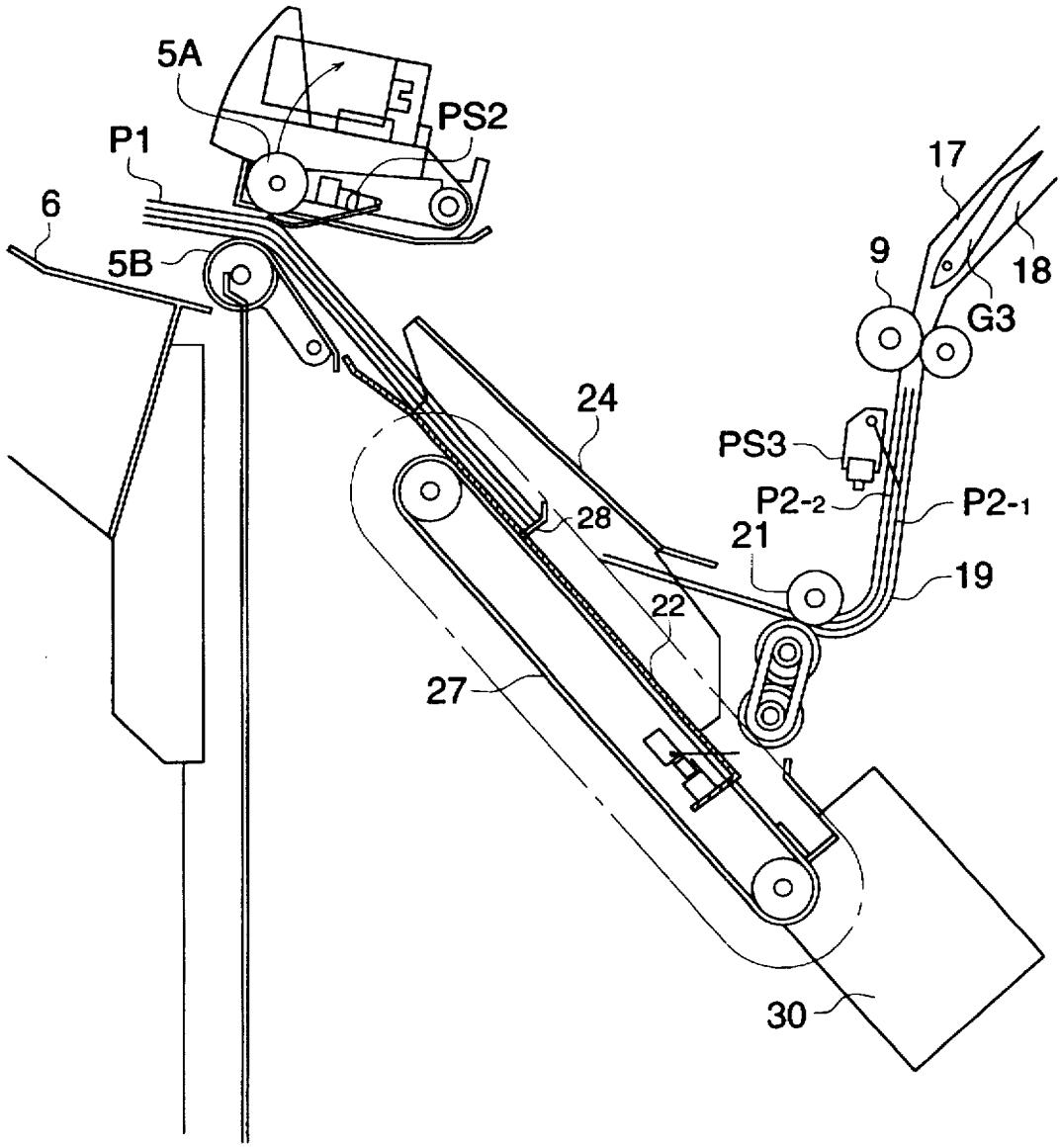
FIG. 10 is a sectional view showing a situation in which the first set of sheets is delivered, and the first and second sheets of the second set of sheets are sent into an intermediate stacker.

FIG. 10 is a sectional view showing the situation in which the first set of sheets P is delivered by a sheet discharging means composed of a discharging belt 27, a discharging claw 28 and a pair of discharging rollers 5, and the first sheet $P2_{-1}$ and the second sheet $P2_{-2}$ of the second set of sheets P2 are sent onto the intermediate stacker 22.

In a system in which the first sheet of the second copied set is stacked on the stacker, after the final sheet of a plurality of sheets of the first copied set has been stacked, the plurality of sheets of the first copied set being sent from the paired conveyance rollers 9, provided at the sheet entrance of the intermediate stacker 22, to the intermediate stacker 22, and being stacked thereon, and then after the first sheets, mentioned above, have been successively aligned, stapled and delivered, copy productivity is decreased because the interval between sheets is small in a high speed processing copier having high continuous copying speed (the number of copied sheets per minute), the subsequent sheet can not be conveyed into the intermediate stacker 22 during alignment, stapling, and delivering processing, and the copying processes of the copier are inevitably interrupted. When the discharging speed of a set of sheets is increased in order to avoid this problem, a larger driving source is necessary so that time required for alignment and stapling processing can be reduced, resulting in an increase of production cost or noise, which are problems. Further, when the discharging speed is increased, discharging property is lowered, or poor alignment of the set of sheets on the sheet discharging tray 6 is generated.

In the present invention, before the preceding set of sheets P1 is aligned, stapled by a stapler 30, and discharging is completed by the pair of discharging rollers 5, two of the first sheet $P2_{-1}$ and the second sheet $P2_{-2}$ of the subsequent set of sheets P2 are ready at the position of the paired conveyance rollers 21; while the set of sheets P1 is being delivered by the pair of discharging rollers 5, conveyance of the first sheet $P2_{-1}$ and the second sheet $P2_{-2}$ of the subsequent set of sheets P2 onto the intermediate stacker 22 starts; and thereby, the first sheet $P2_{-1}$ and the second sheet $P2_{-2}$ of the subsequent set of sheets P2 are simultaneously conveyed in such a manner that they follow the trailing edge of the preceding set of sheets P1, which are in the process of being delivered.

Figure 11:
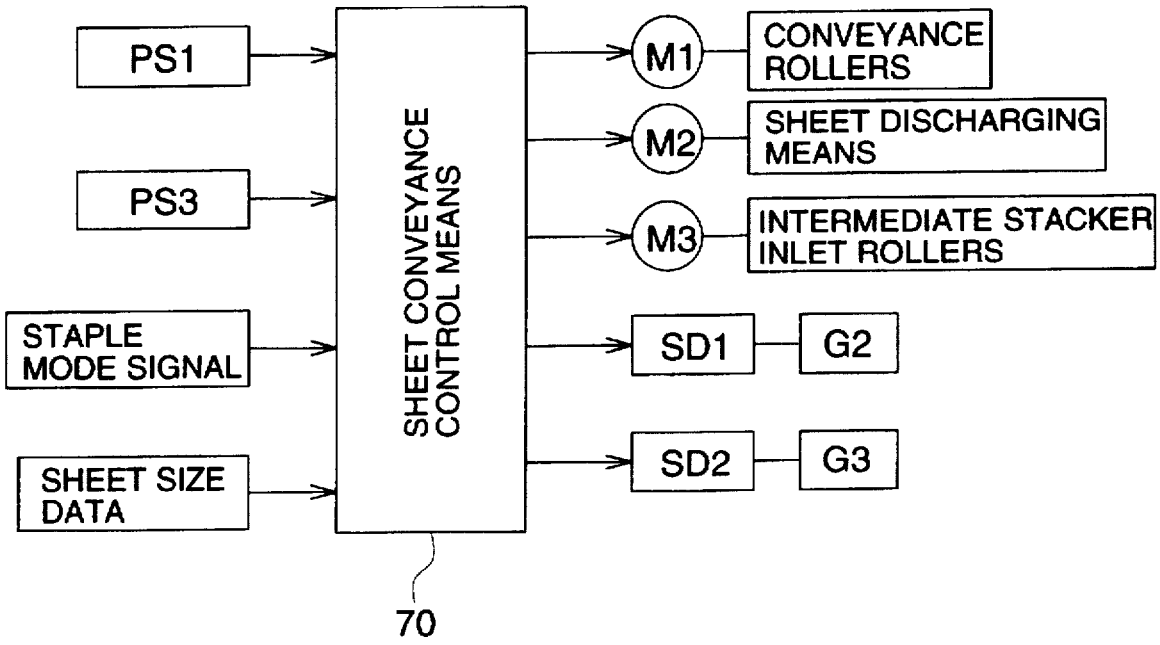
FIG. 11 is a block diagram of a control means for controlling the paired conveyance rollers and a switching gate in a stapling mode.
Figure 12:
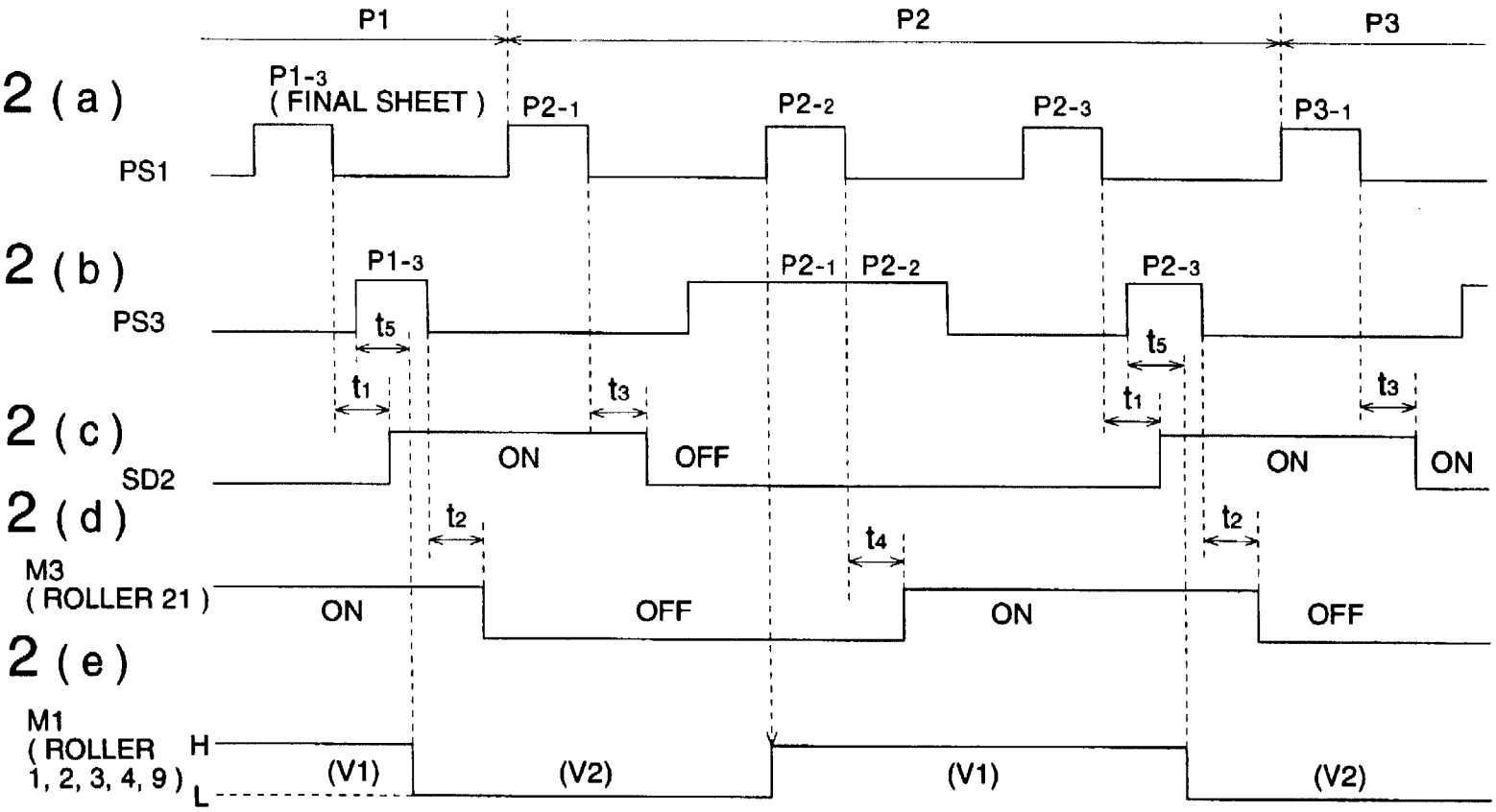
FIGS. 12(*a*) through 12(*e*) are timing charts illustrating a conveyance control for the first and second sets of sheets.

FIG. 11 is a block diagram of a control means which controls motors M1, M2, M3 which drive paired conveyance rollers 1, 2, 3, 9, and 21, and solenoids SD1 and SD2, which activate the switching gates G2 and G3, in the stapling mode. FIGS. 12(*a*) through 12(*e*) are timing charts showing the conveyance control for the preceding first copied set P1 and the subsequent second copied set P2. Incidentally, for this description, the number of sheets of each set of copied sheets is set at 3, and the conveyance control for them will be described below. Herein, in the drawings, $P1_{-3}$ means the third sheet of the first copied set. $P2_{-1}$, $P2_{-2}$, and $P2_{-3}$ respectively mean the first, the second, and the third sheet of the second copied set. In the same manner, $P3_{-1}$ means the first sheet of the third copied set.

(1) Prior to the start of copying operations, a sheet discharge mode (stapling mode or non-stapling mode) is selected and set, and the number of document sheets, and the number of copy sets are designated. Automatic detection and setting for the size of the sheets (recording sheets), on which images are formed, by an automatic paper selector (APS) on the side of a copier main body or a printer main body, or manual setting for the sheets on an operation panel, is carried out, and stapling mode signals, sheet size data, and data of the number of sheets are sent from the side of the image forming apparatus main body to the control section of the sheet finisher.

(2) When the start button of the image forming apparatus main body is pressed, the copying or printing operation starts, and then the process enters the stapling operation. In the stapling mode for larger sized sheets, the upper roller 5A of a paired discharging rollers opening/closing driving means 50 is swung upward, and stops at the position shown in FIG. 7. In this opened situation of the sheet discharging path, a sheet P, conveyed in the third conveyance path 300 of the sheet finisher, advances to a stapling processing section 20, is discharged by the paired conveyance rollers 21, jumps obliquely upward, and slides on the intermediate stacker 22; the leading edge portion of the sheet passes above a lower roller SB of the paired conveyance rollers 5 under the opened condition, and arrives at the above portion of the sheet discharging tray 6; then, the sheet P slides downward on the lower roller 5B and the intermediate stacker 22, or stacked sheets on it, by its own weight; and then the trailing edge of the sheet P comes into contact with the stopper surface m of a stopper member 31 of the stapler 30 and is stopped, in cooperation with a conveyance auxiliary rotation member 23. In this way, in this conveyance process, an alignment member 24 is moved for sheet alignment in the direction of sheet width powered by the drive a stepping motor M6. In the stapling mode for small sized sheets, the sheet P is conveyed and stacked onto the intermediate stacker 22, in the closed situation of the paired discharging rollers 5.

(3) After t1 seconds after the trailing edge of the final sheet (the third sheet) $P1_{-3}$ of the preceding first copied set P1 has passed through an entry sensor PS1, a solenoid SD2 is activated, and the third switching gate G3 is switched so that the first entry path 18 allows passage of the sheets (refer to FIG. 8).

(4) After t2 seconds after the trailing edge of the final sheet (the third sheet) $P1_{-3}$ of the preceding first copied set P1 has passed through a stacker entry sensor PS3, a motor M3 is turned off so that the rotation of the paired conveyance rollers 21 located above the entry-side of the intermediate stacker 22 is stopped. The first sheet $P2_{-1}$ is conveyed by paired conveyance rollers 1, 2 and 9, passes through the first entry path 18 and the path 19, and the leading edge of the sheet comes into contact with the near portion of the nip position of the stopped paired conveyance rollers 21 and is consequently stopped.

(5) After t3 seconds after the trailing edge of the first sheet $P2_{-1}$ of the subsequent copied set P2 has passed through the entry sensor PS1, the solenoid SD2 is turned off, and the third switching gate G3 is switched so that the second entry path 17 allows passage of the sheet (refer to FIG. 9). The second sheet $P2_{-2}$ is conveyed by paired conveyance rollers 1, 2 and 9, passes through the second entry path 17 and the path 19, after which the leading edge of the sheet comes into contact with the near portion of the nip position of the stopped paired conveyance rollers 21, stops, and is stacked on the preceding sheet $P2_{-1}$.

(6) After t4 seconds after the trailing edge of the second sheet $P2_{-2}$ of the subsequent copied set P2 has passed through the entry sensor PS1, the motor M3 is driven so that the rotation of the paired conveyance rollers 21, located above the entry-side of the intermediate stacker 22, is started. Due to this operation, the sheets, in which the second sheet $P2_{-2}$ is stacked on the first sheet $P2_{-1}$, are simultaneously delivered on the intermediate stacker 22.

Figure 13:
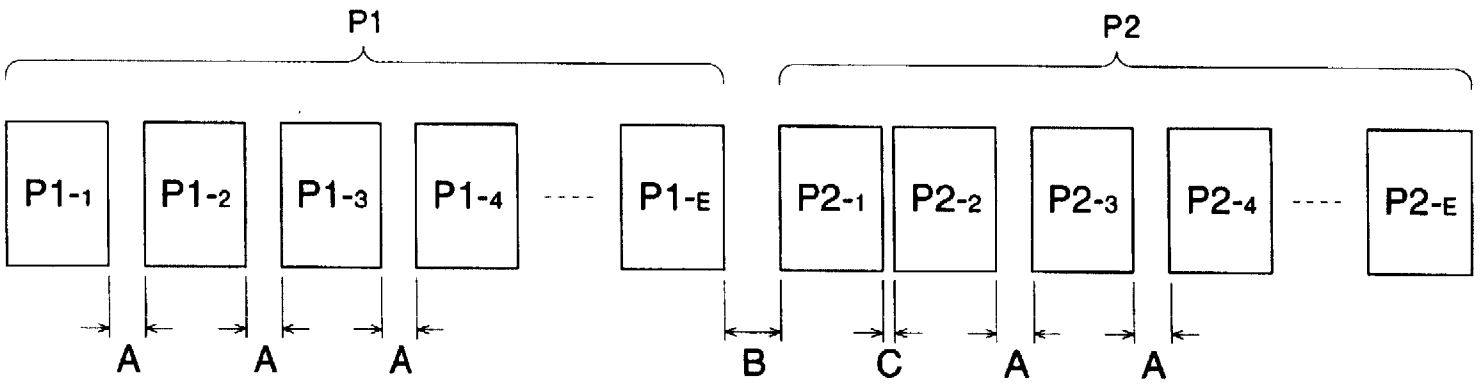
FIG. 13 is an illustration showing interval times of each sheet arriving at a nipping position of the paired conveyance rollers.

(7) After t5 seconds after the leading edge portion of the final sheet $P1_{-3}$ of the preceding first copied set P1 has activated the stacker entry sensor PS3, the speed of the motor M1 is decreased, and the conveyance speed of the paired conveyance rollers 1, 2, 3, 4 and 9 is reduced from a high speed V1 to a low speed V2. Next, when the leading edge portion of the second sheet $P2_{-2}$ of the second copied set P2 activates the inlet sensor PS1, the speed of the motor M1 is restored from the reduced speed, and the sheet conveyance speed of the paired conveyance rollers 1, 2, 3, 4 and 9 is restored from the low speed V2 to the high speed V1. Due to this, time, in which the leading edge portion of the first sheet $P2_{-1}$ of the second or later copied set arrives at the nip position of the paired conveyance rollers 21, is delayed, so that the starting time to stop the rotation of the paired conveyance rollers 21, at which the sheet $P2_{-1}$ comes into contact, is delayed. Accordingly, time is minimized, during which the paired conveyance rollers 21 are stopped before the leading edge portion of the first sheet $P2_{-1}$ of the second or later copied sets arrives at the nip position of the paired conveyance rollers 21, after the completion of the alignment of the preceding set of sheets P1 by the rotation of the paired conveyance rollers 21 and the conveyance auxiliary rotation member 23. Due to this operation, the sheets of the first copied set are assuredly aligned, and the first sheet $P2_{-1}$ and the second sheet $P2_{-2}$ of the second copied set are assuredly placed on each other, resulting in an increase of productivity and stability of the sheet finishing processing. FIG. 13 is an illustration showing time intervals between sheets which arrive at the nip position of the paired conveyance rollers 21. Each sheet of the first copied set P1 is conveyed at a time interval A. The arrival time of first sheet $P2_{-1}$ of the second copied set P2 to the paired conveyance rollers 21 is delayed when the conveyance speed is decreased from V1 to V2, and the time interval B between the trailing edge portion of the final sheet $P1_{-E}$ and the leading edge portion of the first sheet $P2_{-1}$ of the second copied set P2 is increased. The second sheet $P2_{-2}$ is conveyed at a predetermined conveyance speed, and the time interval between it and the first sheet $P_{2-1}$ is C. Accordingly, the time interval can be expressed as follows:

$$B+C=2A$$

(8) When a predetermined number of sheets P1 have been stacked on the lower roller 5B and the intermediate stacker 22, and finally aligned, stapling processing is conducted. Prior to this stapling processing, the stapling position and the stapling number have previously been selected and designated.

(9) After the stapling process has been completed, the control means 70 drives the motor M3 which powers the paired discharging rollers opening/closing driving means 50 so that the upper roller 5A is swung downward, and the entire set of sheets is nipped between the upper roller 5A and the lower roller 5B.

(10) Simultaneously, the control means 70 drives the motor M2, and starts the movement of a discharging belt 27 and rotation of the paired discharging rollers 5. Due to these operations, the set of stapled sheets is conveyed by the discharging belt 27, the discharging claw 28, and the paired discharging rollers 5.

(11) Following the trailing edge of the preceding set of sheets P1, the first sheet $P2_{-1}$ and the second sheet $P2_{-2}$ of the subsequent set of sheets P2 are simultaneously conveyed onto the intermediate stacker 22.

In this connection, in the example of the present invention, a sheet finisher connected to copiers is shown. However, the present invention can also be applied to a sheet finisher which is connected to an image forming apparatus such as printers or facsimiles, or small printing devices, or similar apparatus.

According to the sheet finisher of the present invention, the following excellent effects are attained: (1) the copy productivity is increased because sheets are efficiently conveyed without delay or stoppage of image formation and continuous sheet discharging in the image forming apparatus, while after-finishing operations for the preceding set of sheets are relayed to conveyance operations for the subsequent set of sheets; (2) sheets are assuredly aligned because adequate time is allowed in which the trailing edge of the final sheet of the preceding set of sheets is aligned on an intermediate stacker; and (3) complicated and long sheet conveyance paths are not necessary, and thereby, the overall size of the sheet finisher can be reduced.

What is claimed is:

1. A sheet finisher for use with an image forming apparatus, for receiving and aligning sheets discharged from the image forming apparatus, for then stapling the sheets together and for ejecting the stapled sheets to an exit tray, the sheet finisher comprising:

(a) an intermediate stacker for receiving and aligning sheets discharged from the image forming apparatus;

(b) conveyance means for superimposing a first sheet and a second sheet in a sheet conveyance path upstream of the intermediate stacker, and then for conveying the superimposed sheets to the intermediate stacker to form a succeeding set of sheets to be stapled which follows a preceding set of sheets in the intermediate stacker;

(c) driving means for driving the conveyance means; and (d) control means for controlling the driving means with respect to an operation timing thereof.

2. The sheet finisher of claim 1 further comprising:

a first sheet entry path for guiding the first sheet discharged from the apparatus;

a second sheet entry path for guiding the second sheet discharged from the apparatus; and switching means for switching between a first entry part of the first entry path and a second entry part of the second entry path.

3. The sheet finisher of claim 2, wherein the control means decelerates a conveyance speed of the first sheet of the succeeding set of sheets to be stapled before the second sheet of the succeeding set of sheets is received in the sheet conveyance path.

4. The sheet finisher of claim 3, wherein the conveyance means conveys the superimposed sheets to the intermediate stacker after leading edges of the sheets have been aligned.

5. The sheet finisher of claim 2, wherein a leading edge of the first sheet passed through the first entry part and a leading edge of the second sheet passed through the second entry part are collided with the conveyance means so that the two sheets are superimposed and then the conveyance means holds the two sheets and conveys to the intermediate stacker.

6. The sheet finisher of claim 5, wherein the sheet conveyance means comprises a paired conveyance rollers capable of being rotated for conveying sheets to the intermediate stacker or being stopped for stopping the sheets, the first sheet entry path is formed in a part of the sheet conveyance path through which the sheet discharged from the apparatus is conveyed to the paired conveyance rollers, the second sheet entry path is separated in an upstream portion of the first sheet entry path and is joined in a downstream portion of the first sheet entry path, the switching means switches the sheets discharged from the apparatus so as to pass through either the first sheet entry path or the second sheet entry path, and the control means controls the paired conveyance roller to stop or drive to rotate, and the switching means, and wherein while the preceding set of sheets is stacked, aligned and then stapled on the intermediate stacker, the control means controls the paired conveyance rollers to stop so that the first sheet of the succeeding set of sheets which has passed through the first sheet entry path is in contact with the paired conveyance rollers stopped, and controls so that the second sheet of the succeeding set of sheets which has passed through the second sheet entry path is in contact with the paired conveyance rollers stopped for waiting while being superimposed with the first sheet, and before the preceding stapled set of sheets has been ejected from the intermediate stacker, the control means begins to drive the paired conveyance rollers to rotate so that the first and second sheets of the succeeding set of sheets while superimposed together are simultaneously conveyed to the intermediate stacker.

7. The sheet finisher of claim 1, wherein a stapling operation for the sheets is conducted in the intermediate stacker.

* * * * *